US007474593B2

(12) United States Patent
Pearson

(10) Patent No.: US 7,474,593 B2
(45) Date of Patent: Jan. 6, 2009

(54) VARIABLE DELAY APPLIANCE HYBRID PROGRAM TIMER

(75) Inventor: James E. Pearson, Downers Grove, IL (US)

(73) Assignee: Bobertshaw Controls Company, Carol Stream, IL (US)

( * ) Notice: Subject to any disclaimer, the term of this patent is extended or adjusted under 35 U.S.C. 154(b) by 350 days.

(21) Appl. No.: 11/075,205

(22) Filed: Mar. 8, 2005

(65) Prior Publication Data

US 2006/0202563 A1 Sep. 14, 2006

(51) Int. Cl.
*G04B 47/00* (2006.01)
*D06F 33/00* (2006.01)

(52) U.S. Cl. ..... 368/10; 68/12.01; 68/12.23

(58) Field of Classification Search ..... 368/9, 368/10; 68/12.02, 12.16, 12.23, 12.27; 307/141.4
See application file for complete search history.

(56) References Cited

U.S. PATENT DOCUMENTS 2,841,003 A * 7/1958 Conlee ..... 68/12.14
3,046,421 A * 7/1962 Holzer ..... 307/141
3,770,376 A * 11/1973 Sharpe ..... 8/158
4,449,384 A * 5/1984 Jones ..... 68/12.21
5,150,489 A * 9/1992 Kaji et al. ..... 8/159
5,272,892 A * 12/1993 Janutka et al. ..... 68/12.02
6,047,486 A * 4/2000 Reck et al. ..... 34/491

* cited by examiner

*Primary Examiner*—Vit W Miska
(74) *Attorney, Agent, or Firm*—Reinhart Boerner Van Deuren P.C.

(57) ABSTRACT

A timer control apparatus for use in an appliance is provided. The timer control apparatus includes a timer having a timing motor, a user interface including a setting indicator and option switches, and a delay circuit associated with the timing motor. The delay circuit is operable to halt the timing motor and to start the timing motor such that the timer control apparatus delays progression of the timing motor. The delay circuit can halt and start the timing motor at regular intervals, irregular intervals, according to a timing pattern, based on the setting indicator, and/or based the option switches. By delaying the timing motor, travel or progression of the setting indicator between settings is reduced.

4 Claims, 7 Drawing Sheets

VARIABLE DELAY APPLIANCE HYBRID PROGRAM TIMER

FIELD OF THE INVENTION

This invention pertains to a timer control apparatus for an appliance, and more particularly to a timer control apparatus for an appliance that is operable to provide variable length cycles by incorporating a delay of a timing motor.

BACKGROUND OF THE INVENTION

A typical appliance, such as a washer, dryer, or dishwasher, contains a timer, a timing motor, and user interface having a setting indicator. The timing motor and the setting indicator are linked or coupled together such that progression of the timing motor results in corresponding and proportional travel by the setting indicator.

The setting indicator on the appliance permits a user to select from one of a number of settings or cycles. To select a cycle, the user simply manipulates a setting indicator until the setting indicator is aligned with a desired setting on the user interface of the appliance. Thereafter, to start the appliance, the user further initiates the appliance by pushing in or pulling out the setting indicator, by pushing a start button, etc. For example, with a standard washer, if the user wanted to wash a load of cotton clothes, the user would position the setting indicator to the "cotton fabrics" setting and commence that cycle.

Based on the particular setting chosen by the user, the timing motor in the appliance operates for a specific length or duration of time. As the timing motor operates, the setting indicator correspondingly progresses (i.e., rotates, travels) from one setting to another on the user interface. Unfortunately, rotation of the timing motor is often directly proportional to the rotation of the setting indicator on the user interface. When one moves, they both move. This can cause significant hardship since the area proximate the setting indicator on the user interface is limited.

As an example of the limitations that can arise, if a "delicate fabrics" setting is selected, a washer might agitate the delicate fabrics for six minutes. For those six minutes, the timing motor is enabled and proportionally progresses the setting indicator through the "delicate fabrics" cycle (i.e., progresses the setting indicator from the "delicate fabrics" setting to a "done" setting or position on the user interface). In this example, if a circular one-hour timing motor was used, the setting indicator would have moved one-tenth of a revolution (6 min./60 min.) around the user interface since the timing motor and the setting indicator are directly linked together. Likewise, a "cotton fabrics" setting might agitate a load for twelve minutes. For those twelve minutes, the timing motor is enabled and proportionally progresses the setting indicator through the "cotton fabrics" cycle (i.e., progresses the setting indicator from the "cotton fabrics" setting to a "done" setting or position on the user interface). If a circular one-hour timing motor was once again used, the setting indicator would have moved two-tenths of a revolution (12 min./60 min.) around the user interface since the timing motor and the setting indicator are directly linked together.

Despite only two settings having been offered in above example, three-tenths or thirty percent of the user interface is occupied. As can be appreciated by those skilled in the art, the number of settings that can be placed on a user interface is limited when travel of the setting indicator is directly proportional to movement of the timing motor.

To address this issue, appliance manufacturers have made efforts to delay the timing motor at the beginning of a cycle, and consequently, travel of the setting indicator on the user interface. Unfortunately, such prior timers only utilized a single, non-user selectable delay that was confined to the initiation of the cycle. This operation resulted in perceivable non-uniform travel of the user interface dial. Specifically, for the entire delay period the user interface dial does not move from its starting point. Then, once the delay has expired, the user interface dial travels quickly through the arc of the cycle. As such, a user cannot accurately judge if the timer is working properly, how much time is left in a cycle, etc.

In another instance, delays were mechanically incorporated into a timing motor. While this tactic helped the timing motor reduce travel of the setting indicator, the solution did not permit input from the user of the appliance. The timing motor would implement the same delay or delays no matter what was desired by the user or where in the wash cycle the appliance happened to be operating.

A further approach taken by appliance manufacturers was to introduce a delay by controlling appliances using electronic means (i.e., eliminating the timing motor and using an electronic timer). While this produced some desirable results, this improvement was expensive. As such, this solution was not particularly feasible for the highly cost-competitive appliance market.

Thus, an apparatus that can provide multiple delays to a timing motor at various times during a cycle without relying on exclusively mechanical or electronic means would be desirable. Likewise, the apparatus would be easily configurable to, or retro fit to, timers typically found in common appliances such as washers, dryers, and dishwashers. The invention provides such an apparatus. These and other advantages of the invention, as well as additional inventive features, will be apparent from the description of the invention provided herein.

BRIEF SUMMARY OF THE INVENTION

In one aspect, the invention provides a timer control apparatus for use in an appliance. The timer control apparatus comprises a timer including a timing motor and a delay circuit associated with the timing motor. The delay circuit is operable to halt the timing motor and to start the timing motor such that the timer control apparatus delays progression of the timing motor. The delay circuit is operable to halt and start the timing motor at regular intervals, at irregular intervals, and/or based on a predetermined or user programmable pattern.

The timer control apparatus, and more particularly the delay circuit, receives one or more inputs from a setting indicator and/or one or more inputs from a plurality of option switches. The delay circuit uses one or more of the inputs to decide the which delay pattern to select. In an alternate embodiment of the present invention, the timer control apparatus further includes a microprocessor for storing one or more of the delay patterns.

In another aspect, the invention provides a timer control apparatus for use in an appliance that has a timer including a timing motor, a user interface, and a delay circuit. The user interface includes a plurality of option switches and a setting indicator, the setting indicator having a first setting and a second setting. The delay circuit is associated with the timer and the user interface, operable to halt the timing motor, and operable to start the timing motor based on a setting indicator input from the setting indicator and a switch input from one or more of the plurality of option switches. As such, progression of the timing motor is delayable.

In a further aspect, the invention provides a method of delaying the travel of a setting indicator on the user interface of an appliance. The method comprises the steps of allowing travel of the setting indicator from a first setting toward a second setting on the user interface and halting progression of the setting indicator between the first setting and the second setting on the user interface. The method further comprises the steps of permitting a predetermined amount of time to elapse and restoring travel of the setting indicator from the first setting toward the second setting on the user interface after the predetermined time has elapsed. As such, travel of the setting indicator on the user interface of the appliance has been delayed. In one embodiment, the method comprises repeating the steps of halting, permitting, and restoring.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
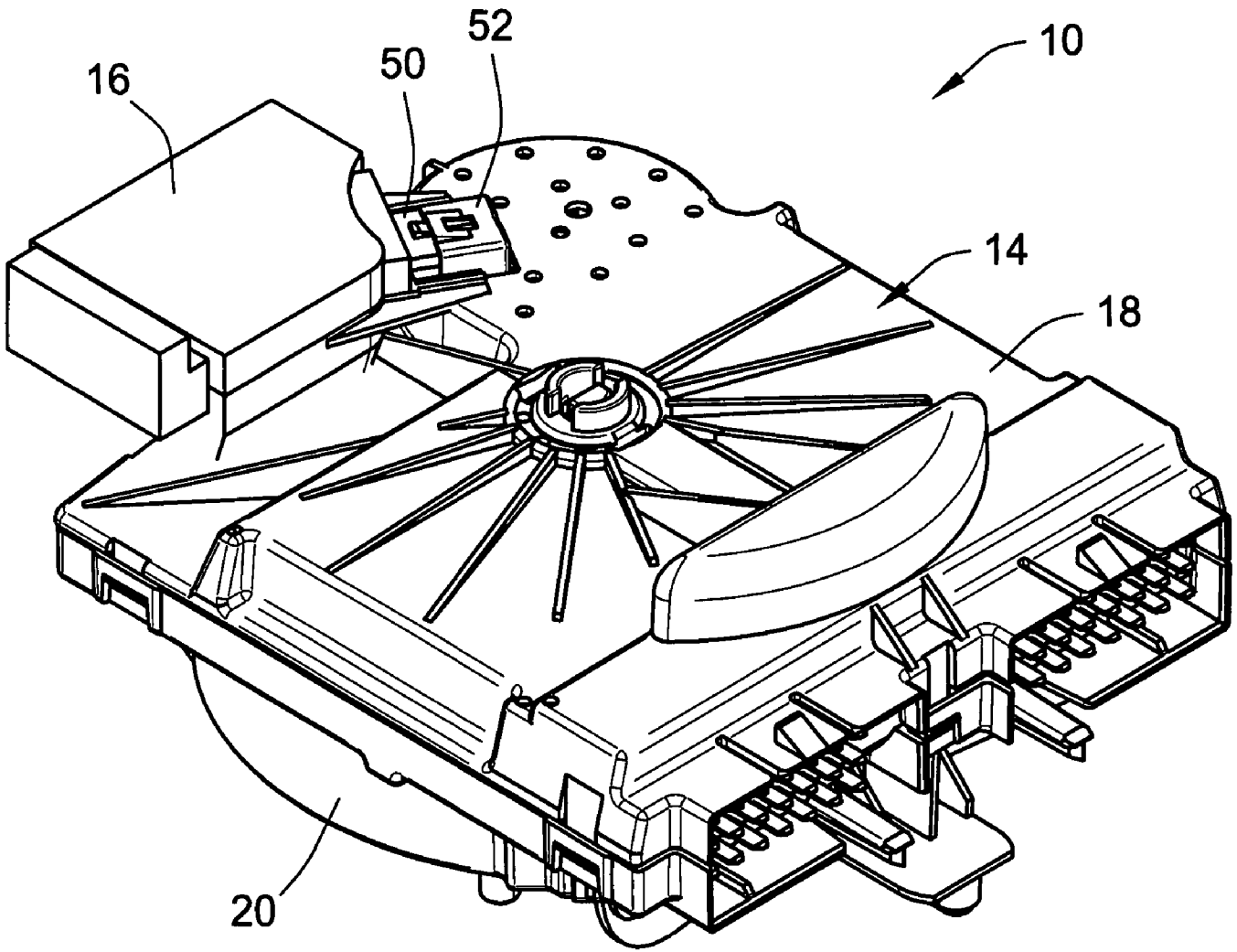
FIG. 1 is a perspective view of a timer control apparatus.
Figure 2:
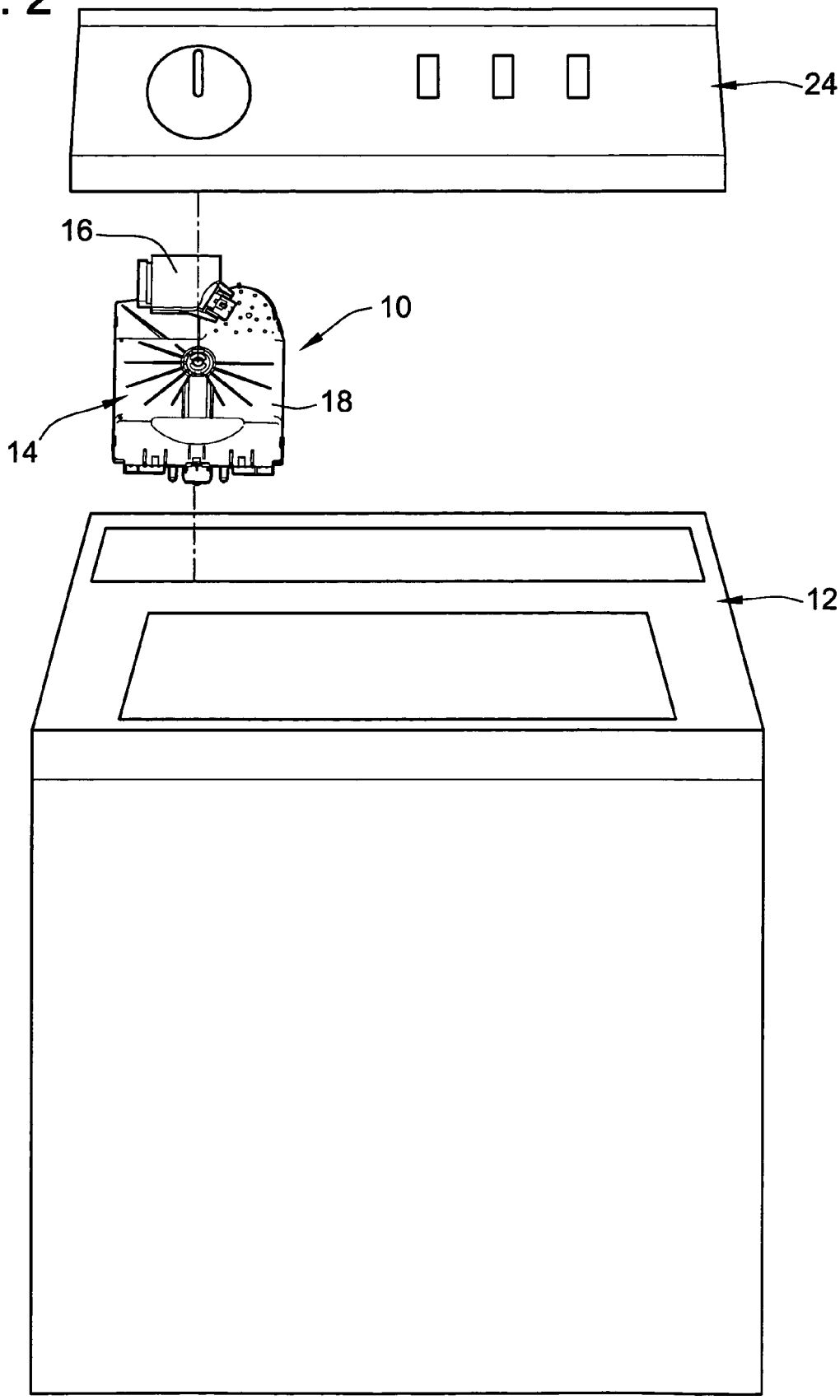
FIG. 2 is an exploded front elevational view of an appliance housing the timer control apparatus of FIG. 1.
Figure 3:
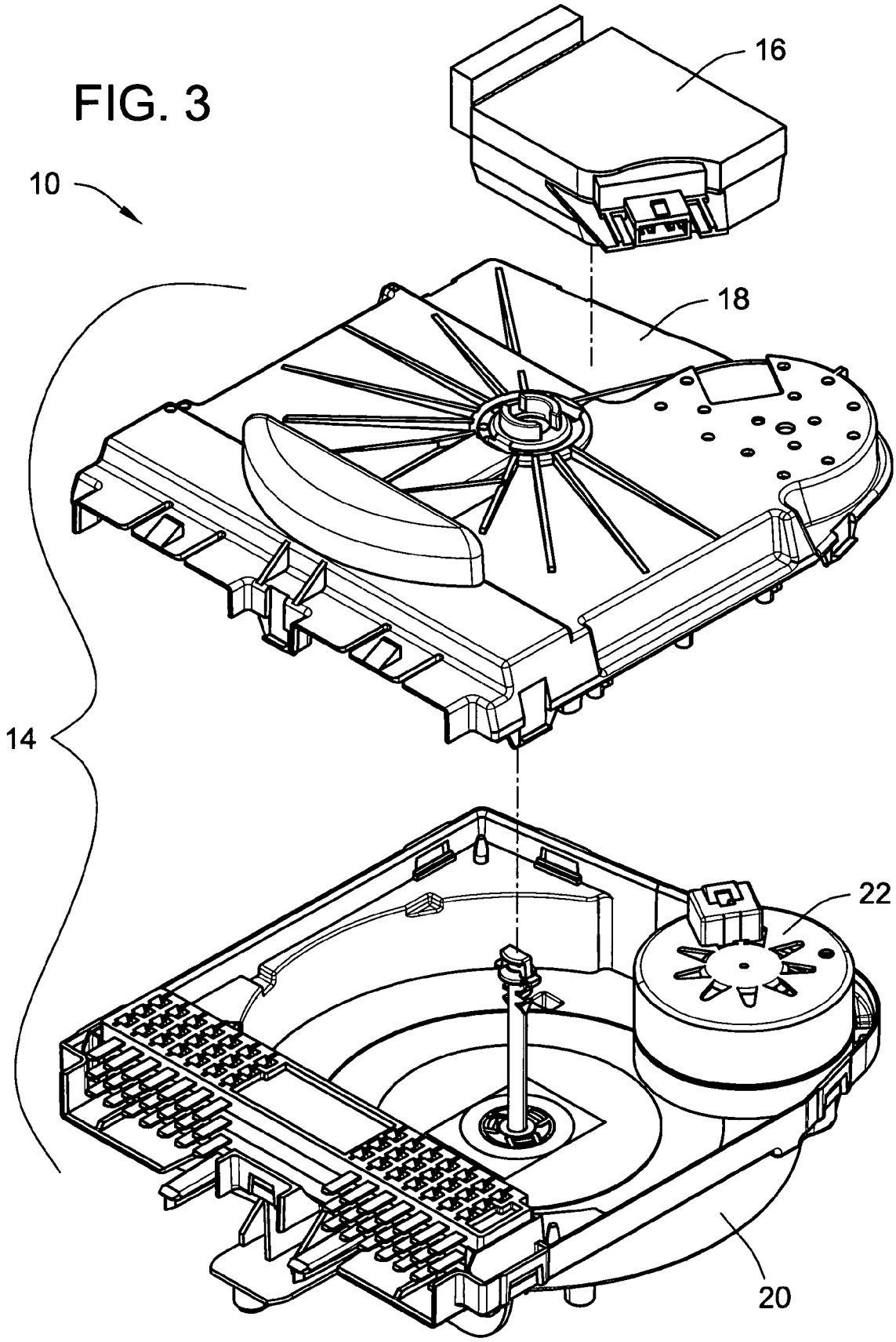
FIG. 3 is an exploded perspective view of the timer control apparatus of FIG. 1 highlighting a motor disposed therein.

Referring to FIGS. 1-3, an embodiment of a timer control apparatus 10 constructed in accordance with the teachings of the present invention for use in an appliance 12 (e.g., a washer, dryer, dishwasher, and the like) is illustrated. Timer control apparatus 10 comprises timer 14 and delay circuit 16. As illustrated in the figures, the delay circuit 16 may be housed in an enclosure separate from the timer 14 enclosure. In such embodiments, a connector assembly 50 is used to interface the delay circuit 16 to the motor connector 52 of the timer 14. This allows the delay circuit to be utilized with current appliance timer assemblies to provide the enhanced functionality enabled by the inclusion of the delay circuit 16. Alternatively, the delay circuit may be integrated into the timer assembly housing 18.

In one embodiment, the timer 14 housing is of a two-piece construction having a timer front cover 18 and a timer back cover 20 that houses the timing motor 22, among other known parts of a timing mechanism including a program cam, internal timer switches (typically eight or sixteen), and the like. (not shown). Timer 14 can be one of a variety of appliance timers known in the art and available from the assignee of the instant application such as, for example, a 570 timer, a 571 timer, a one-hour timer, and the like. One skilled in the art will also recognize from the teachings of the present invention that other timing mechanisms that utilize a timing motor may be used as well. Timing motor 22 is often disposed within, and encapsulated by, timer 14 housing 18, 20. However, the timing motor 22 may also be separate from the timing assembly 14. Timing motor 22 is, in preferred embodiments, a single-phase, alternating-current synchronous motor.

Figure 4:
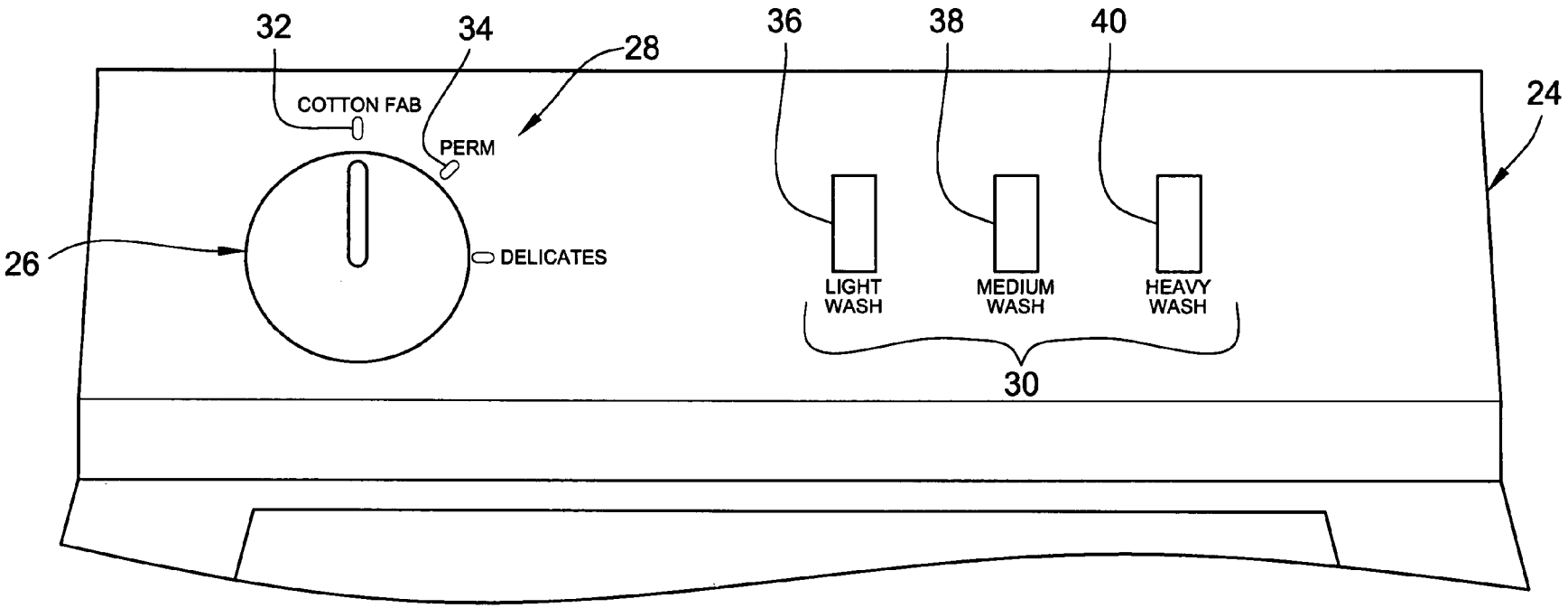
FIG. 4 is a fragmentary front elevational view of a user interface located on the appliance of FIG. 2.

The delay circuit 16 is an electronic device or system that operates to start, stop, re-start, re-stop, and so on, timing motor 22 to control the actual time that any one cycle operates and to control the movement of the setting indicator 26 (see FIG. 4). Therefore, delay circuit 16 is enabled to move, progress, halt or delay timing motor 22 which provides control over the movement or cessation of movement of timing motor 22.

Turning to FIG. 4, a exemplary appliance front panel user interface 24 for an appliance 12 with which the present embodiment finds particular applicability is depicted. The front panel user interface 24 comprises a setting indicator knob 26, a graphic illustrating the rotary position of a plurality of settings or cycles 28, and a plurality of option switches 30. As is well known, the user interface 24 generally provides the user of the appliance 12 with a means to control the operations, functions, cycles, and choices available and provided by the appliance.

To provide direct correlation between the position of the setting indicator knob 26 and program controlled by the position of the program cam (not shown), the setting indicator knob 26 is typically mechanically coupled to the program cam. As is known, the program cam is coupled, often though at least one gear, to the timing motor 22. Therefore, the setting indicator 26 proportionally moves, progresses, and/or travels as the timing motor 22 drives the cam. In other words, when the timing motor 22 starts or stops, the setting indictor 26 correspondingly starts or stops.

The setting indicator knob 26 utilizes the plurality of settings 28 on the front panel graphic, such as a first setting 32 and a second setting 34, as reference markers to indicate to the user in which cycle the appliance is operating. Therefore, the setting indicator 26 is able to indicate and/or display the position and/or the progression through each cycle as the program cam and indicator knob 26 are driven by the timing motor 22. The setting indicator 26 performs this function by stopping at, traveling between, or moving relative to the plurality of settings 28. For example, the setting indicator 26 can be aligned by the user (or automatically by the timing motor) with the first setting 32, travel toward the second setting 34, and finally stop at the second setting 34 when the cycle defined between these two settings is complete.

For the visual convenience and aesthetic benefit of the user of the appliance 12, the plurality of settings 28, including the first setting 32 and the second setting 34, are often individually labeled and associated with one of a variety of cycles such as, for example, "cotton fabrics", "permanent press", and "delicates" as shown in FIG. 4. These cycle names quickly advise the user of the appliance 12 as to which of the plurality of settings 28 that has been chosen, the position of setting indicator knob 26 relative to the settings 28, the last cycle completed, the cycle the appliance is currently engaged in, and the like.

While the setting indicator 26 is represented as a rotating control (e.g., a knob) in FIG. 4, the setting indicator 26 is not limited to this shape, configuration, or method of movement. Setting indicator 26 can comprise any mechanical and/or electronic display capable of alerting the user of appliance 12 as to the status or progression of the setting indicator and/or operation of the appliance.

Still referring to FIG. 4, a plurality of option switches 30 is shown. Again, for the visual convenience and aesthetic benefit of the user of appliance 12, the option switches 30, including the first switch 36, the second switch 38, and the third switch 40, can be individually labeled with a variety of names such as, for example, "light wash", "medium wash", and "heavy wash", "lightly soiled", "regular wash", and "heavily soiled", and the like. As shown in FIG. 4, each option switch 36, 38, 40 in the plurality of switches 30 directly corresponds to one of the particular wash types on user interface 24. While only three option switches 36, 38, 40 are shown in FIG. 4, it is contemplated that the plurality of option switches 30 can, and often does, include either fewer or more of the switches that, in turn, correspond to further types of cycle adjustments.

In the illustrative example of FIG. 4, the option switch 36 corresponds to a light wash, the option switch 38 corresponds to a medium wash, and the option switch 40 corresponds to a heavy wash. Since each of the plurality of option switches 30 are associated with these different wash types, a user of the appliance 12 is permitted to select a desired wash type. Selection of the desired wash type can be based on, among other factors, the amount of soil on clothes and/or the duration of time that the user of the appliance desires the machine to operate. Since each wash type, from light to medium to heavy, progressively increases the agitate time and/or overall cycle time of the appliance 12, the clothes are either washed for a shorter amount of time, for a medium amount of time, or for a longer period of time. Thus, the option switches 30 permit the user to determine the amount of time that the appliance 12 will operate regardless of the setting 28 (e.g., "cotton fabrics", "permanent press", "delicates") that has been chosen using setting indicator 26. In other words, the actual duration of each cycle selected by selection indicator 26 may be varied by the selection of one of the option switches 30.

Figure 5:
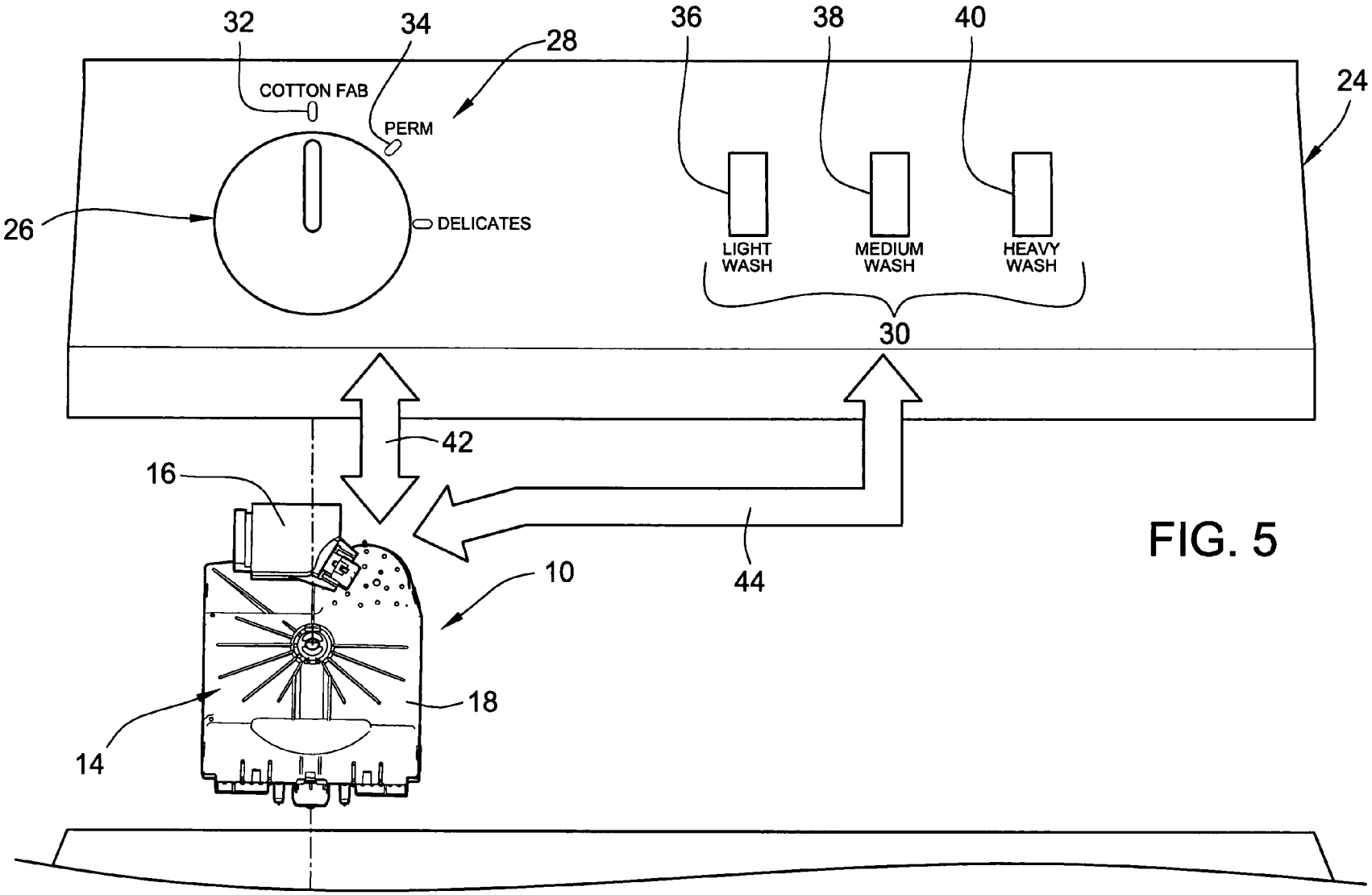
FIG. 5 is a schematic of the timer control apparatus of FIGS. 1 and 2 in operation with the user interface of FIG. 4.
Figure 6:
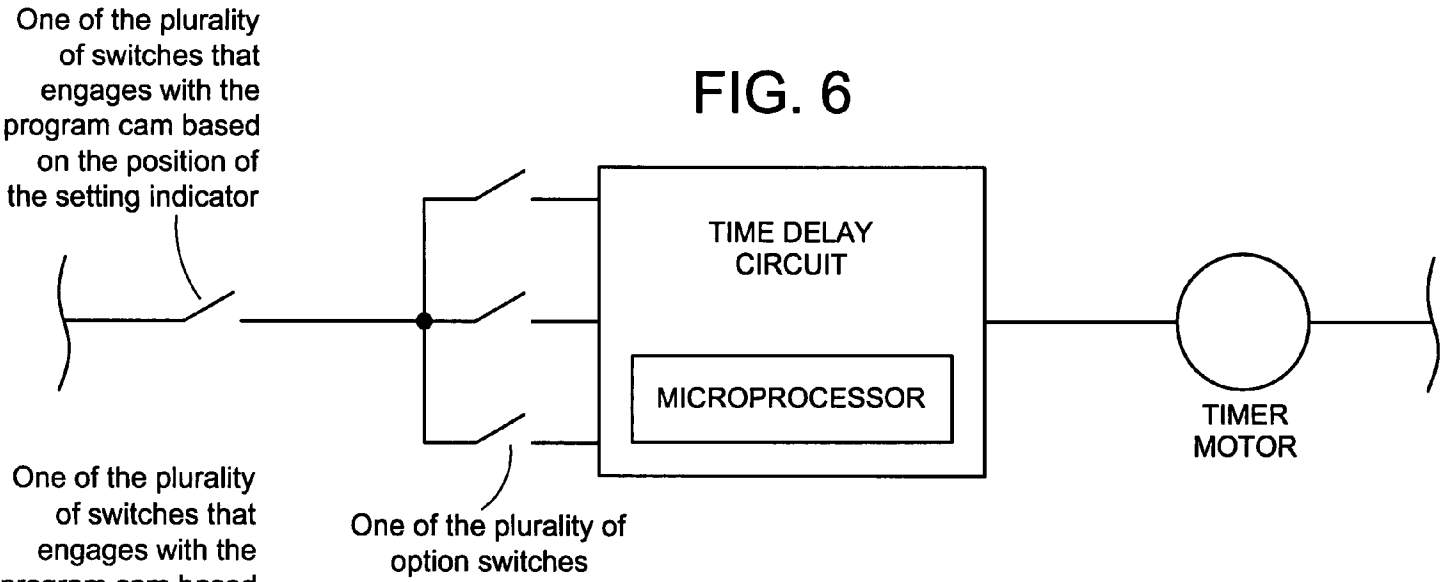
FIG. 6 is a simplified single line schematic of the time delay apparatus of FIG. 1.
Figure 7:
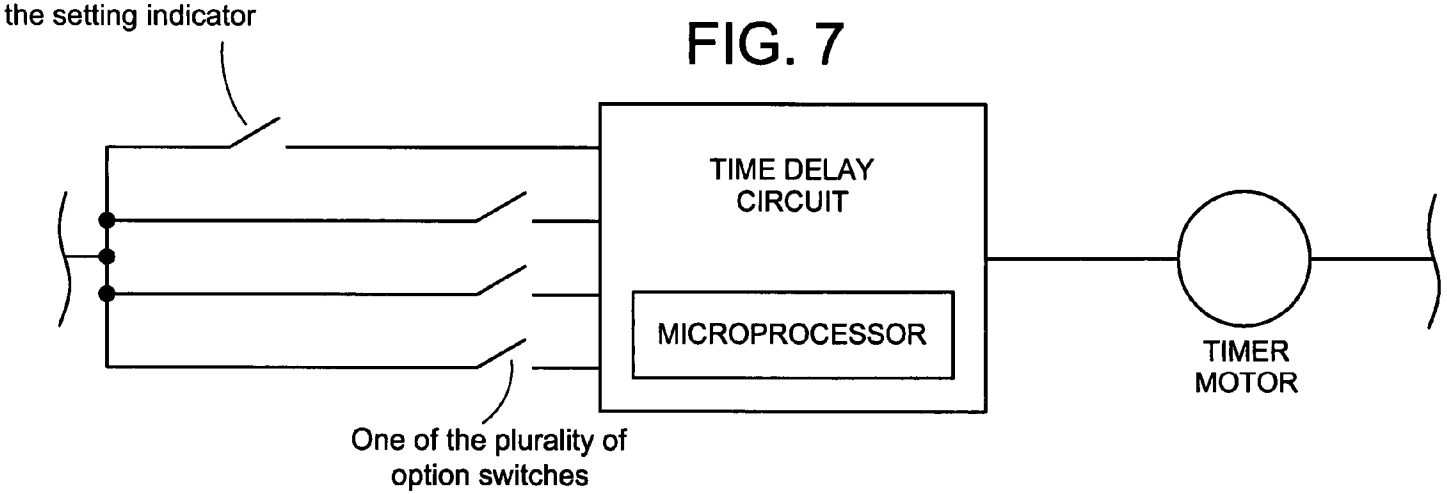
FIG. 7 is another simplified single line schematic of the time delay apparatus of FIG. 1.

Once the timer 14 having the delay circuit 16 is disposed in the appliance 12, the delay circuit 16 functions to intermittently and/or temporarily delay the operation of the timing motor 22 based upon one or more signals 42 (see FIG. 5) relating to the position of the setting indicator knob 26 (i.e., the position of the program cam and relative to one of the plurality of internal timer switches), and one or more signals 44 from the option switches 30. In one embodiment of the present invention illustrated in simplified single line schematic form in FIG. 6, the delay circuit is activated when the setting indicator 26 is in a particular position (i.e., the setting indicator has engaged one of the plurality of internal timer switches with the program cam) and when one of the plurality of option switches 30 is selected. In another embodiment of the present invention illustrated in simplified single line schematic form in FIG. 7, the plurality of internal timer switches that engage with the program cam are in parallel with the plurality of option switches. Again, the particular internal timer switch that is closed depends on the position of the setting indicator 26.

In operation, a user of appliance 12 selects one of a plurality of cycles 28 on the user interface 24 with the setting indicator 26 by, for example, rotating the setting indicator into alignment with one of the plurality of settings 28. Thereafter, based on the wash type desired, the user selects or depresses one of the plurality of option switches 30 on user interface 24. For instance, the user can select the setting labeled "cotton fabrics" 32 from the plurality of settings 28 and then depress the switch labeled "heavy wash" 40 from the plurality of option switches 30 if the user wanted to wash very dirty cotton t-shirts in the appliance 12.

After the desired cycle and type have been chosen, the user commences operation of appliance 12 by, for example, "pushing in" or "pulling out" the setting indicator 26 to activate the appliance 12. While such action is typical in appliances such as the appliance 12, it is not exclusive. For example, a "start" or "go" switch could also be used to begin operation of the appliance 12. The order of operations and relative timing for each function within the selected cycle are typically encoded on the program cam of the timer. In the exemplary embodiment being discussed, such functions may include opening the hot water valve, the cold water valve, energizing the agitator, energizing the drain pump, initiating the spin cycle, etc. While the timing of each of these functions was controlled by the relative spacing of the program falls on the cam based on a given speed of the timer motor, the actual and relative timing of each of these functions in the system of the present invention is controlled, at least in part, by the delay circuit 16. That is, the delay circuit 16 can lengthen the time of any of the functions in a cycle by delaying or de-energizing the timer motor 22 for a period during any of these functions.

When the appliance 12 begins operating, the timing motor 22 is energized and starts to move or rotate the program cam and setting indicator knob 26 on user interface 24. In other words, travel of the setting indicator 26 from, for example, the first setting 32 toward the second setting 34 on the user interface 24 is initiated. Without the delay circuit 16 of the present invention, the timing motor 22 will continue to rotate the setting indicator 26 through the selected cycle in an uninterrupted fashion. However, to provide additional time in any function in the selected cycle, e.g. to agitate the clothes longer for a heavily soiled load, the delay circuit 16 occasionally de-energizes the motor 22 to stop the constant rotation of the setting program cam and therefore the indicator knob 26. To prevent a user from believing that the timer is broken, the first delay is preferably after the timing motor 22 and the setting indicator 26 have begun to travel. Otherwise, and in prior systems, the indicator knob 26 does not move for a long period, leading the user to believe that the timer is broken.

The delay circuit 16 keeps the timing motor 22, the program cam and setting indicator knob 26 idled for a predetermined amount of time. This predetermined amount of time is, in preferred embodiments, also based on the first signal 42 indicating the current function being performed in the selected cycle and the second signal 44 indicating which user option switch 30 has been selected. After the predetermined amount of time has elapsed, the delay circuit 16 re-starts or restores movement of the timing motor 22 and, therefore, permits the program cam and the setting indicator 26 to once again move on user interface 24. This process of halting the timing motor 22, permitting a predetermined amount of time to elapse, and then restoring travel of the motor 22, cam and indicator knob 26 may be repeated multiple times within a particular function of a cycle to provide the user with the visual illusion that the indicator knob 26 is rotating at an apparent constant rotational speed. Alternatively, a single longer delay may be used after the initial rotation has begun if such visual cues are not desired or required.

Notably, during the above process, total travel of the setting indicator 26 is reduced from that which would be needed to accomplish the same time during a cycle if the timer motor 22 were not stopped. In other words, when the motor 22 is temporarily halted, the setting indicator does not travel as far on user interface 24 as the setting indicator would have normally traveled on the user interface during the cycle duration had timing motor 22 not be halted. Thus, travel, movement, and/or progression of setting indicator is condensed. Advantageously, the space or area at a periphery or proximate setting indicator 26 on user interface 24 is conserved. This allows many more cycles to be included on the user interface 24. Likewise, to the user of the appliance 12, the setting indicator 26 still appears to be functioning normally. The only difference is that the setting indicator 26 travels somewhat slower than normal through the program cycle arc since timing motor 22 is, at times, turned off. Thus, the program cam and the setting indicator 26 travel less, the area at the periphery of the setting indicator on the user interface 24 is preserved, and the user of appliance 12 remains unaware that such is occurring because the appliance operates completely normally based on the user's selections.

As will be appreciated by those skilled in the art, having the timing motor 22 temporarily halted from time to time increases the resolution of the timing motor. For example, a ten-minute cycle can be run such that, with respect to the arc through which the setting indicator knob 26 on the user interface 24 travels, the setting indicator 26 moves on the user interface 24 as if a five-minute cycle were run.

Figure 8:
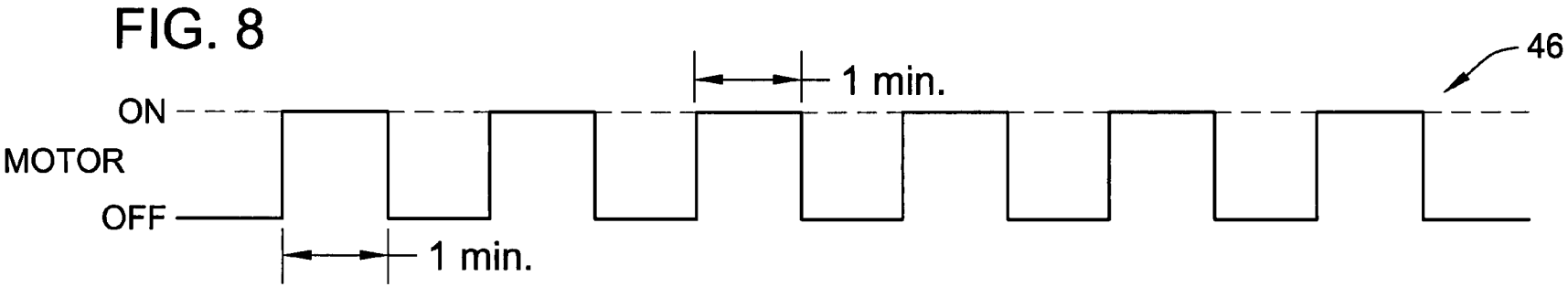
FIG. 8 is an example of a timing pattern usable by the timer control apparatus of FIGS. 1 and 2.
Figure 9:
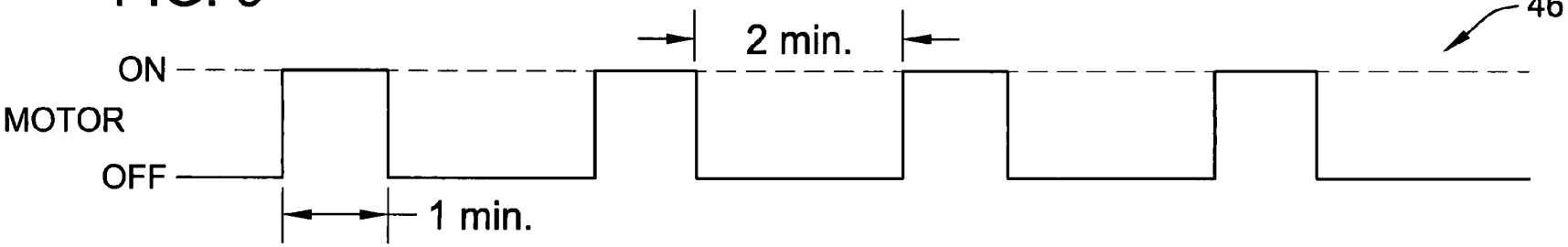
FIG. 9 is an example of a timing pattern usable by the timer control apparatus of FIGS. 1 and 2.
Figure 10:
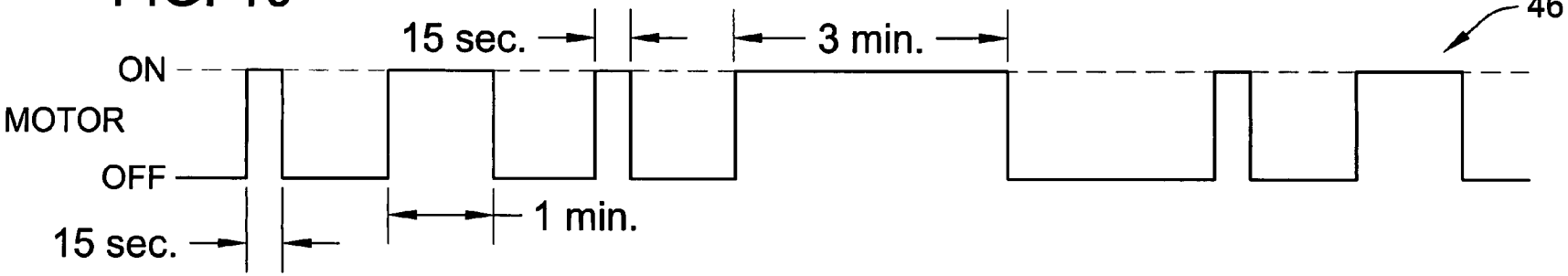
FIG. 10 is an example of a timing pattern usable by the timer control apparatus of FIGS. 1 and 2.

In preferred embodiments, the stopping and starting of the timing motor 22 is performed according to a timing pattern. Such timing patterns may be pre-programmed, or may be variable based on inputs from various sensors utilized in the appliance. Exemplary timing patterns 46 are shown in FIGS. 8-10. Each of these timing patterns is used by the delay circuit 16 to turn the timing motor 22 on and off. The timing patterns are preferably based on the cycle that the appliance 12 is performing, the position of the setting indicator 26 (i.e., the internal timer switch that engages with the program cam), and/or the particular option switch 36, 38, 40 that has been chosen. The individual timing patterns displayed in FIGS. 8-10 are illustrative and are in no way meant to be limiting of the scope of the invention. A variety of different timing patterns is contemplated and can be produced. The timing patterns 46 may comprise regular intervals, irregular intervals, or mixtures thereof, and may vary for each of the individual functions performed in each of the cycles.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An appliance, comprising:

a cycle timer including a timing motor;

a user interface having selectable thereon at least one option switch and a setting indicator, the setting indicator having a first setting and a second setting associated therewith;

a delay circuit operably coupled to the timer and the user interface, the delay circuit operable to de-energize the timing motor to halt the timing motor after the timing motor has rotated the setting indicator a given distance from a starting position of the setting indicator wherein the timing motor rotates the setting indicator immediately after a start of operation of the appliance before a first de-energization of the timing motor and to re-energize the timing motor to start the timing motor based on a cycle input from the setting indicator and activation of the at least one option switch; and wherein the at least one option switch on the user interface includes a light wash option switch, a medium wash option switch, and a heavy wash option switch, and wherein the delay circuit de-energizes the timing motor to halt the timing motor for a period of time based on which one of the light wash option switch, the medium was option switch, and the heavy wash option switch is activated.

2. The appliance of claim 1, wherein the delay circuit de-energizes the timing motor to halt the timing motor after the timing motor has rotated the setting indicator the given distance from the starting position of the setting indicator only during an agitation time of a washing cycle of the appliance.

3. An appliance comprising:

a cycle timer including a timing motor;

a user interface having selectable thereon at least one option switch and a setting indicator, the setting indicator having a first setting and a second setting, associated therewith;

a delay circuit operably coupled to the timer and the user interface, the delay circuit operable to de-energize the timing motor to halt the timing motor after the timing motor has rotated the setting indicator a given distance from a starting position of the setting, indicator and to re-energize the timing motor to start the timing motor based on a cycle input from the setting of the at least one option switch;

wherein the delay circuit is operable to halt and to start the timing motor at irregular intervals according to a predetermined timing pattern based on the cycle input from the setting, indicator and the activation of the at least one option switch; and wherein the at least one option switch on the user interface comprises a light wash option switch, a medium was option switch, and a heavy wash option switch, and wherein the delay circuit is operable to de-energize the timing motor to halt the timing motor after the timing motor has rotated the setting indicator the given distance from the starting position of the setting indicator and to re-energize the timing motor to start the timing motor based on a combination of the cycle input from the setting indicator and which one of the light wash option switch, the medium was option switch, and the heavy wash option switch is activated.

4. The appliance of claim 3, wherein the delay circuit de-energizes the timing motor to halt the timing motor after the timing motor has rotated the setting indicator the given distance from the starting position of the setting indicator only during an agitation time of a washing cycle of the appliance.

* * * * *